US006775865B1

(12) United States Patent
Lin

(10) Patent No.: US 6,775,865 B1
(45) Date of Patent: Aug. 17, 2004

(54) SHOWER UNIT WITH SWIVEL SPRAY ARMS

(75) Inventor: Shih-Hung Lin, Taichung Export Processing Zone (TW)

(73) Assignee: Globe Union Industrial Corp., Taichung Export Processing Zone (TW)

( * ) Notice: Subject to any disclaimer, the term of this patent is extended or adjusted under 35 U.S.C. 154(b) by 0 days.

(21) Appl. No.: 10/630,668

(22) Filed: Jul. 31, 2003

(51) Int. Cl.[7] ..... A47K 3/22
(52) U.S. Cl. ..... 4/615; 4/601; 4/596
(58) Field of Search ..... 4/601, 615, 596; 239/587.1–587.5, 548, 550; 285/273, 275, 276, 261, 263, 264, 237

(56) References Cited

U.S. PATENT DOCUMENTS

| | | | | | |
|---|---|---|---|---|---|
| 201,689 | A | * | 3/1878 | Leermo | 285/261 |
| 3,375,532 | A | * | 4/1968 | Gellmann | 4/601 |
| 3,663,043 | A | * | 5/1972 | Walton | 285/261 |
| 3,874,706 | A | * | 4/1975 | Arnold | 285/261 |
| 3,997,197 | A | * | 12/1976 | Marsh et al. | 285/261 |
| 4,040,650 | A | * | 8/1977 | Shotbolt | 285/261 |
| 4,180,285 | A | * | 12/1979 | Reneau | 285/261 |
| 4,381,871 | A | * | 5/1983 | Dopyera et al. | 285/261 |
| 4,809,369 | A | * | 3/1989 | Bowden | 4/615 |
| 5,564,139 | A | * | 10/1996 | Shorr | 4/601 |
| 6,286,158 | B1 | * | 9/2001 | Lin | 4/601 |
| 6,643,862 | B2 | * | 11/2003 | Aitken | 4/601 |
| 2003/0189337 | A1 | * | 10/2003 | Palmer | |

* cited by examiner

*Primary Examiner*—Gregory L. Huson
*Assistant Examiner*—Khoa Huynh
(74) *Attorney, Agent, or Firm*—Leong C. Lei

(57) ABSTRACT

An improved structure of swivel shower spray arms, wherein, a swivel connection is provided between each spray arm and the showerhead to allow manual adjustment for the spray angle as desired by the bather.

2 Claims, 5 Drawing Sheets

SHOWER UNIT WITH SWIVEL SPRAY ARMS

BACKGROUND OF THE INVENTION

1. Field of the Invention

The present invention is related to an improved structure of a shower unit with multiple swivel spray arms, and more particularly, to one with spray arms that are manually adjustable for the desired spray angle.

2. Description of the Prior Art

Referring to FIGS. 3 and 4 of the accompanying drawings of the present invention, a shower unit provided with multiple spray arms generally available in the market is essentially comprised of a shower unit 30 pivoted with multiple spray arms 40. Wherein, each of those spray arms is related to a hollow arm 40 pivoted to the circumference of a showerhead 31. The spray arm 40 is connected to the showerhead 31 at a pivot level 41 protruding from the showerhead 31. The outer circumference of the pivot lever 41 is threaded to engage into that provided in an opening of the showerhead 31 to fix the spray arm 40 to the showerhead 31. Water delivered into the showerhead 31 is then sprayed out of multiple holes 42 provided in each spray arm 40 for showering purpose (detailed design of the prior art will be given in the specification of the present invention). The prior art offers the following advantages:

1. Weight reduction of the shower unit. With the design of multiple spray arms, the structural weight inherited to the larger area of spray found with the conventional dome type can be reduced while maintain a certain spray area; and
2. Improved structural strength. The design of having each spray arm pivoted to the showerhead and the showerhead connected to the delivery pipe improves the structural strength and water pressure resistance of the shower unit. Whereas the conventional dome type of the shower unit has a considerably large volume and is the water is sprayed only through the outer circumference of a water outlet disk welded to the casing of the showerhead, the inherited volume of the dome and the applied water weight and pressure will easily lead to the hazard of blow up of the spray disk at where it is welded to the showerhead.

However, the prior art also presents the flaw that it is spray angle permits only in one direction. Event though the spray angle of prior art as a whole can be adjusted by turning at where the top of the prior art connected to the spray arm the spray direction is fixed at one direction only. When one takes a shower, special spray angle or a certain focus area is required depending on the height or the standing posture of the individual bather. The water spray from a plane does not fall on the bather with the same area or effectively spray on a particular part of the body of the bather as desired, particularly so true the lower body is concerned, after a certain angle of elevation and the impacts from the central gravity.

SUMMARY OF THE INVENTION

The primary purpose of the present invention is to provide a shower unit provided with multiple spray arms with each arm adjustable for its swivel spray angle while the angle of the arm itself is also adjustable by manual.

The foregoing object and summary provide only a brief introduction to the present invention. To fully appreciate these and other objects of the present invention as well as the invention itself, all of which will become apparent to those skilled in the art the following detailed description of the invention and the claims should be read in conjunction with the accompanying drawings. Throughout the specification and drawings identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENT

The following descriptions are of exemplary embodiments only, and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

Figure 1:
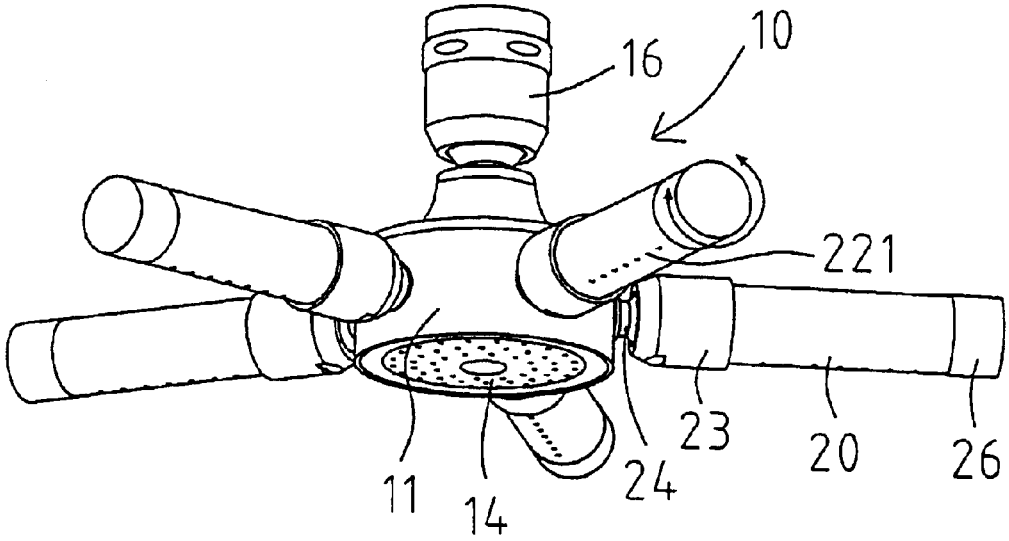
FIG. 1 is a perspective view of a preferred embodiment of the present invention.
Figure 2:
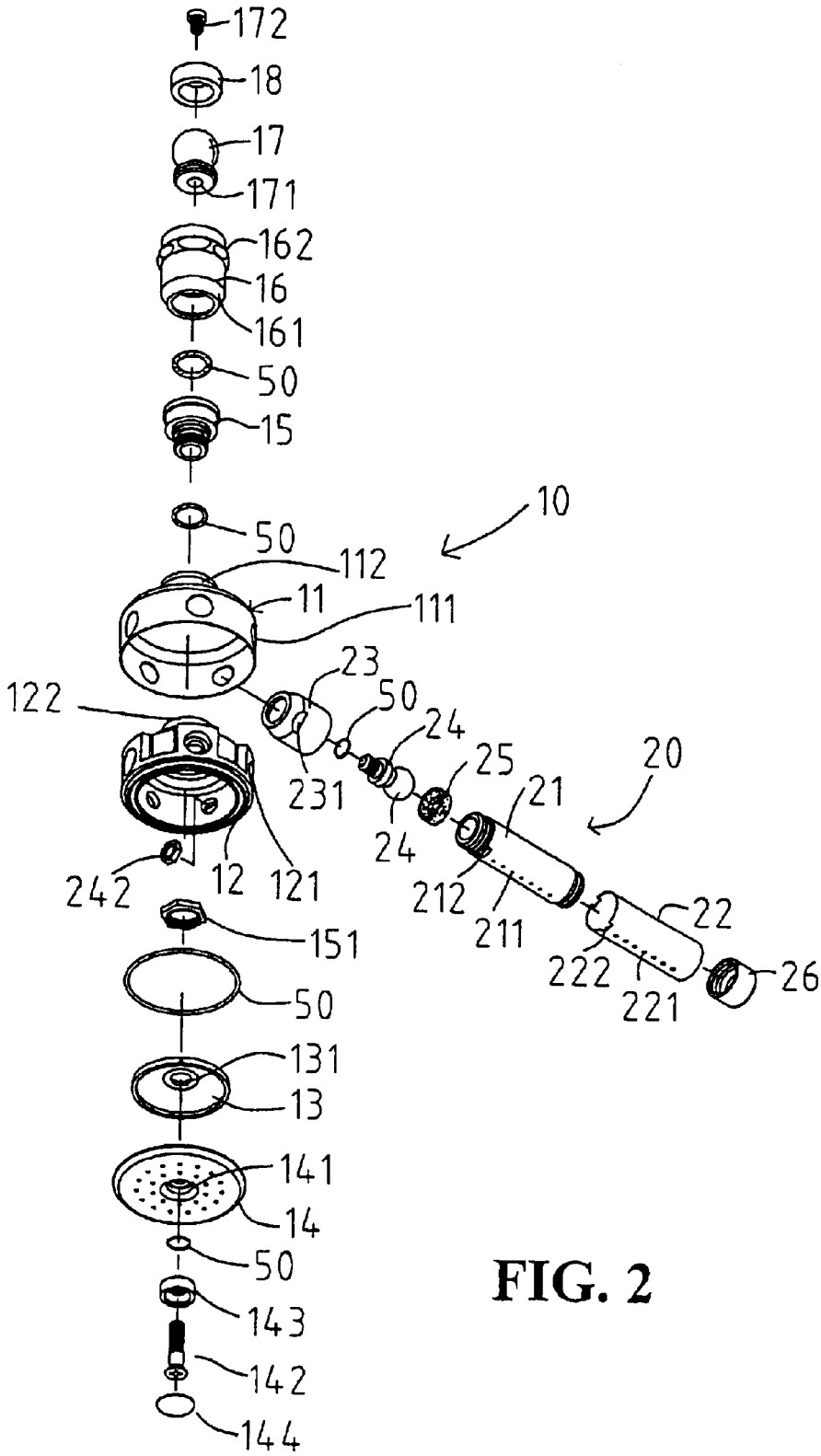
FIG. 2 is an exploded view of the preferred embodiment of the present invention.
Figure 3:
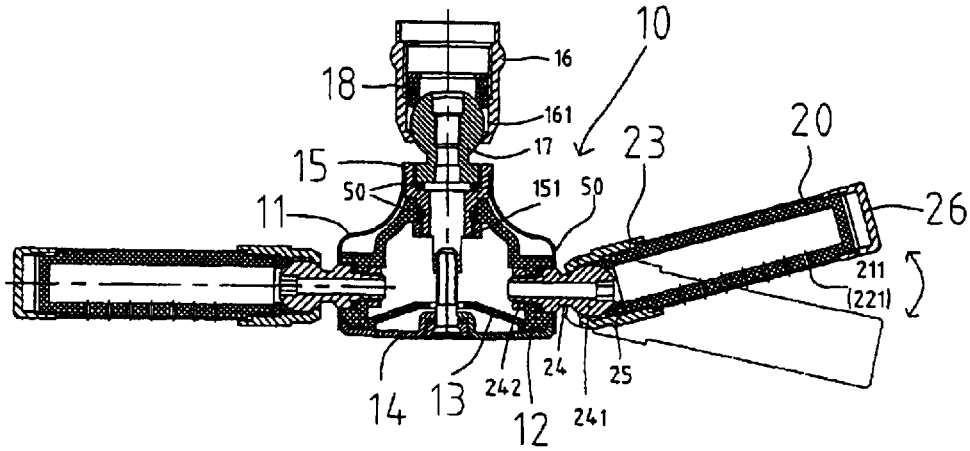
FIG. 3 is a sectional view of an assembly of the preferred embodiment of the present invention.
Figure 4:
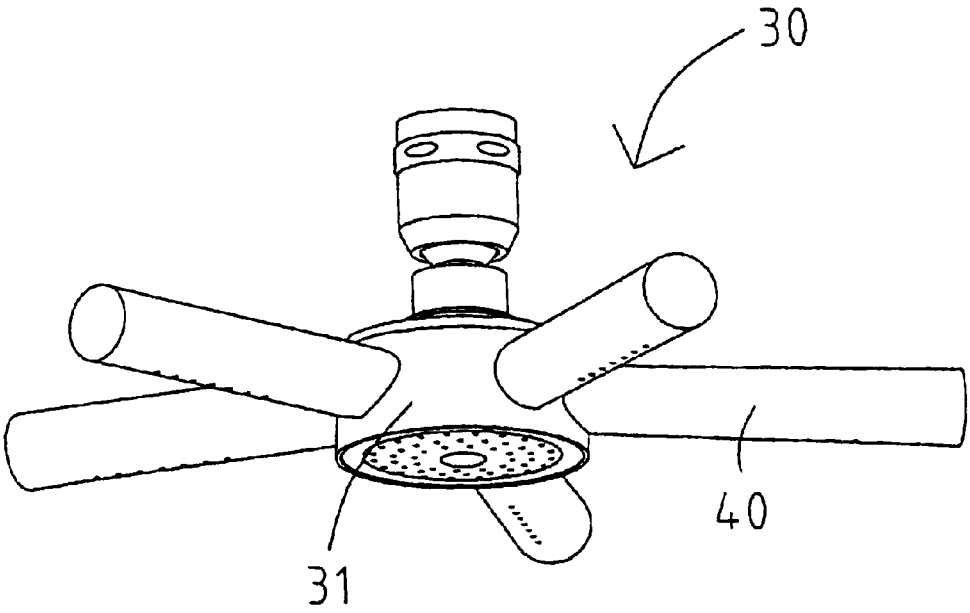
PRIOR ART FIG. 4
FIG. 4 is a perspective view of the prior art.
Figure 5:
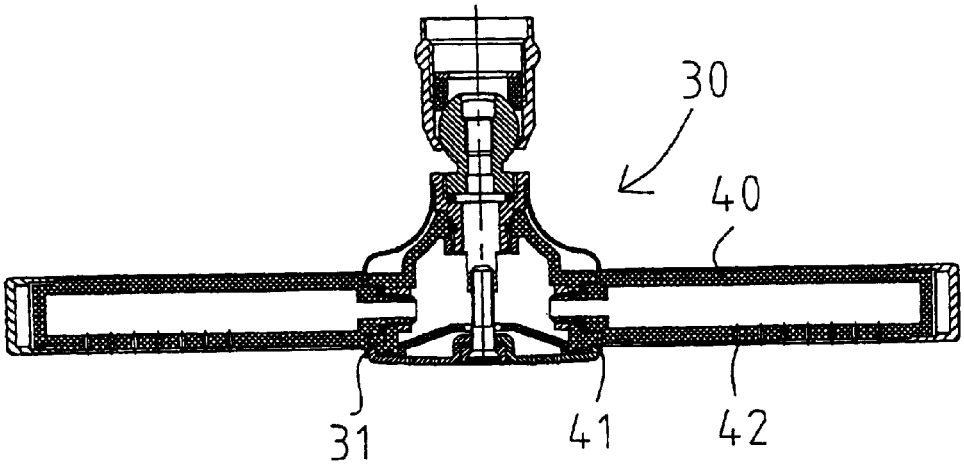
PRIOR ART FIG. 5
FIG. 5 is a sectional view of the prior art

Referring to FIGS. 1, 2, and 3, a preferred embodiment of the present invention is essentially comprised of a shower unit 10, a casing 11, a showerhead 12 and multiple spray arms 20. Wherein, the assembly of the casing 11, and showerhead 12 and their connections to the spray aims are related to the prior art. The casing 11 relates to a dome cover having a circular hood at its bottom and five through holes 111 around its outer circumference. A spindle in comparatively smaller diameter protrudes from the top of the hood and showerhead 12 is inserted into the interior space of the hood. The showerhead 12 constitutes the primary supporting structure for the shower unit 10. The external circumference of the showerhead 12 is designed to allow it to be inserted into the internal space of the casing 11 while multiple pivoting holes 121 to match those through holes 111 are provided on the side round surface of the showerhead 12. Each of those pivoting holes 121 is provided with an inner thread at its inner circumference to be pivoted to its relative spray arm 20. A cylindrical object with an axial hole 122 protrudes from the top of the showerhead 12 to merely inert into the spindle and the lower part of a shaft 15 before being secured with a locking nut 155 screwing in downward at where below the shaft 15. The lower part of the shaft 15 is inserted with a check ring 50 so to close up a space between the shaft 15 and the inner circle of the axial hole 122. A separation ring 13 is inserted into the inner bore at where below the showerhead 12 and a water inlet 131 is provided at the center of the separation ring. A trough is provided at the lower round end of the showerhead to first receive the insertion of the check ring 50 and then to be covered with a water outlet plate 14. The water outlet plate 14 is provided at its center a round pivoting hole 141, and multiple pores on its plane to allow spray of water. A locking screw 142 first penetrates a rotation ring 143 and the check ring 50 then enters through the pivoting hole 141 and the water inlet hole 131 of the separation ring 13 to engage with the inner thread provided in the inner circumference of the lower part of the shaft 15, and finally a circular plate 144 is inserted into the inner circumference of the round pivoting hole 141 to close up. The top of the shaft 15 relates to a round recess provided with inner thread for the shaft to be screwed to a threaded rod provided at where below a rolling ball 17. The rolling ball 17 containing a hollow water passage 171 has a spherical top and a lower rod provided with an outer thread. The lower rod of the rolling ball 17 first passes through a conic end 161 provided at where below a support tube 16, then packed with another check ring 50 and finally engaged with the top of the shaft 15 in the assembly process as described above. Meanwhile, the ball top of the rotation ball 17 has its comparatively larger bore to limit the travel of the conic end 161 of the supporting pipe 16 to where below the ball of the rotation ball 17 and the shaft 15. A hollow water saving screw 172 to admit water inlet is screwed into the water passage 171 at the top of the rotation ball 17. A resistance ring 18 is inserted to the top of the rotation ball 17 inside the support tube 16, and a hexagonal ridge 162 that can be operated with a wrench protruding from the external circumference of the support tube 16 is used to rotate the support tube 16. The inner thread provided in the inner circumference at the upper end in the support tube 16 is screwed to the end of a water outlet (not illustrated) and packs the resistance ring 18 at where between the ball at the top of the rotation ball 17 and the water outlet tube to complete the assembly of the prior art in the present invention.

The improved structure of the present invention is the design of the spray arm 20. The spray arm 20 is usually having a PVC injection molded inner tube 21 as its main body since those pores 211 provided by PVC injection mold are comparatively refined and deliver ideal spray. A row of spray pores 211 is provided on the edge of the inner tube 21 and both ends of the inner tube 21 are respectively provided with a male thread. Two positioning bits 212 protrude from the terminal of the travel of the thread proximal to the direction of the inner tube 21 in relation to the showerhead 12 to connect a press ring 25, a round joint bolt 24, a check ring 50 and a pivoting tube 23. The round joint bolt 24 is provided with a spherical end and a screw on the other end. The check ring 50 is inserted to the screw of the round joint bolt 24 in the direction to the showerhead 12 and passes through the pivoting tube 23 to be locked into one of the pivoting holes 12 provided on the shower head 12. The press ring 25 holds against the spherical end of the round joint bolt 24, which is then abutted to the inner tube 21 and is locked by having the thread provided at one end of the inner tube to engage into the inner thread of the pivoting tube 23. The diameter of a conic front of the pivoting tube 23 is made slightly smaller than that of the spherical end of the round joint bolt 24 to limit the round joint bolt 24 to rotate only inside the pivoting tube. Multiple cuts are provided on the outer circumference of the pivoting tube 23 to facilitate the operation of the wrench. The press ring 25 relates to a packing provided with a concave inner circumference at an inclination to accommodate the action of the spherical end of the round joint bolt 24 to exercise the resistance of the press ring 25 for the spray arm 20 to stop at a specific position as desired. An outer tube and a cap 26 are inserted to the inner at the distal end of the inner tube 20 in relation to the showerhead 12. The outer tube 22 is usually made of metal and two positioning channels 222 are provided at the proximal end in relation to the showerhead 12 to engage with those two positioning bits 212 provided on the inner tube 21 for multiple pores 221 provided on the outer tube 22 to match those spray holes 211 on the inner tube 21 in position. The cap 26 relates to a round cap provided with an inner thread to be screwed to the threaded end of the inner tube 21, thus to force the outer tube 22 to be secured to the inner tube 21 for completing the assembly of the present invention.

Now referring to FIGS. 1 and 3 particularly at where indicated by arrows, by the multi-oriental rotation of the inner tube 21 adapted with the round joint bolt 24 and the pivoting tube 23, the assembly of the present invention provides the following advantages:

Multi-orientation spray angles are possible for adjustment as desired by the bather simply by pushing or rotating any spray arm, and to certain extent when drastic change of the spray angle is required, the present invention also provides an easy way for the bather to change the spray orientation.

It will be understood that each of the elements described above, or two or more together may also find a useful application in other types of methods differing from the type described above.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the spirit of the present invention.

I claim:

1. In a shower unit with multiple swivel spray arms comprising: a shower unit, a casing, a showerhead and multiple spray arms; the casing related to a dome provided with five through holes around its outer circumference having its lower interior inserted by the showerhead; the showerhead having its outer circumference inserted into the casing and being provided on its side circumference five pivoting holes each internally threaded to connect a spray arm of the swivel spray arms, an axial protruding from the top of the showerhead being fixed at below of the shaft with a locking nut; a separation ring being inserted into the bottom of the showerhead and a water inlet hole being provided at the center of the separation ring; the part of the shaft being inserted with a check ring and covered up with a water outlet plate, a pivoting round hole being provided at the center of the water outlet plat, a locking screw passing through a rotation ring and the check ring to enter through the pivoting hole and the water inlet hole of the separation ring and fixed in place by the inner thread in the inner circumference of the lower part of the shaft; the top of the shaft related to a round recess provided with an inner thread for the shaft to be screwed to a threaded rod provided at where below a rolling ball; the rolling ball containing a hollow Water passage having a spherical top and a lower rod provided with an outer thread; the lower rod of the rolling ball passing through a conic end at where below a support tube, then being packed with another check ring and finally engaged with the top of the shaft; a hollow water saving screw being provided in the water passage hole at the top of the rotation ball; a resistance ring being inserted inside the support tube at where between the spherical ball on the rotation ball and the water outlet tube; wherein the improvement comprises the spray arms including an inner tube, multiple spray holes on the edge of the inner tube, both ends of the inner tube being respectively provided with a male thread; two positioning bits protruding from the terminal of the travel of the thread proximal to the direction of the inner tube in relation to the showerhead to connect a press ring, a round joint bolt, a check ring and a pivoting tube; the round joint bolt having a spherical end and a screw on the other end, the check ring being inserted to the screw of the round joint bolt and passing through the pivoting tube to be locked into one of the pivoting holes on the shower head; the press ring holding against the spherical end of the round joint bolt, the round joint bolt being abutted to the inner tube and locked by having the thread provided at one end of the inner tube to engage into the inner thread of the pivoting tube; the diameter of a conic front of the pivoting tube being made slightly smaller than that of the spherical end of the round joint bolt to limit the round joint bolt to rotate only inside the pivoting tube; multiple cuts being provided on the wall of the pivoting tube to facilitate the operation of the wrench; the press ring related to a packing provided with a concave inner circumference at an inclination to accommodate the action of the spherical end of the round joint bolt; an outer tube and a cap being inserted to the inner at the distal end of the inner tube in relation to the showerhead; two positioning channels being provided at the proximal end in relation to the showerhead to engage with those two positioning bits on the inner tube for multiple pores provided on the outer tube to match those spray holes on the inner tube in position; and a round cap provided with an inner thread being screwed to the threaded end of the inner tube to force the outer tube to be secured to the inner tube.

2. In the shower unit with multiple swivel spray arms as claimed in claim 1, wherein the spray arm including at least one spray arm.

* * * * *